US010994302B2

(12) United States Patent
Kriege et al.

(10) Patent No.: US 10,994,302 B2
(45) Date of Patent: May 4, 2021

(54) CYLINDER, DEVICE AND MACHINE FOR ALIGNING MAGNETIC OR MAGNETIZABLE PARTICLES ON A WEB-LIKE OR SHEET-LIKE SUBSTRATE

(71) Applicant: KOENIG & BAUER AG, Würzburg (DE)

(72) Inventors: Björn Kriege, Veitshöchheim (DE); Edwin Kreps, Zellingen (DE); Anja Kneitz, Karlstadt (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/040,735

(22) PCT Filed: Jan. 15, 2019

(86) PCT No.: PCT/EP2019/050888

§ 371 (c)(1),
(2) Date: Sep. 23, 2020

(87) PCT Pub. No.: WO2019/201480

PCT Pub. Date: Oct. 24, 2019

(65) Prior Publication Data

US 2021/0008592 A1 Jan. 14, 2021

(30) Foreign Application Priority Data

Apr. 18, 2018 (DE) ..... 10 2018 205 885.7

(51) Int. Cl.
*B05D 3/00* (2006.01)
*B41F 13/08* (2006.01)
(Continued)

(52) U.S. Cl.
CPC ..... *B05D 3/207* (2013.01); *B41F 13/08* (2013.01); *B05D 2252/02* (2013.01);
(Continued)

(58) Field of Classification Search
None
See application file for complete search history.

(56) References Cited

U.S. PATENT DOCUMENTS 1,105,844 A * 8/1914 Schaperjahn ..... E21B 17/046 285/330
1,963,365 A * 6/1934 Herold ..... B41N 7/06 101/205
(Continued)

FOREIGN PATENT DOCUMENTS

CN 103192591 A 7/2013
CN 105034570 B 11/2015
(Continued)

OTHER PUBLICATIONS

International Search Report of PCT/EP2019/050888 dated Apr. 15, 2019.

*Primary Examiner* — Jill E Culler
(74) *Attorney, Agent, or Firm* — Mattingly & Malur, PC

(57) ABSTRACT

A cylinder is usable, in particular, for aligning magnetic of magnetizable particles, which are contained in a coating medium that is applied to a first side of a web-like or a sheet-like substrate, which cylinder, in the region of its outer circumference, has a plurality of elements effecting a magnetic field, magnetic elements for short. The magnetic elements are arranged in or on a plurality of ring elements that are spaced axially apart from one another and that are positionable in the axial direction on a shaft, in or on which ring elements, in turn, a plurality of magnetic elements are respectively arranged one after the other in the circumferential direction. At least two adjacent ring elements, each have a covering element, forming a part of the cylindrical lateral surface of the cylinder and extending in the circumferential direction, at least over the circumferential region populated with magnetic elements. The covering elements
(Continued)

of two ring elements adjacent to each other have, on their sides facing each other in the axial direction, a plurality of projections alternating in the circumferential direction with recesses and offset in a circumferential direction in such a way that, during a relative movement of the two ring elements towards each other, the projections on the covering element of one ring element engage, in the manner of teeth, in corresponding recesses of the other ring element, and, as seen in the circumferential direction, can overlap. A security paper printing machine, having such a cylinder, is also disclosed.

10 Claims, 9 Drawing Sheets

(51) Int. Cl.

| | |
|---|---|
| *B41M 3/14* | (2006.01) |
| *B41F 15/12* | (2006.01) |
| *B41F 15/08* | (2006.01) |
| *B41F 13/18* | (2006.01) |
| *B41J 13/076* | (2006.01) |

(52) U.S. Cl.
CPC ..... *B41F 13/18* (2013.01); *B41F 15/0809* (2013.01); *B41F 15/0836* (2013.01); *B41F 15/12* (2013.01); *B41J 13/076* (2013.01); *B41M 3/14* (2013.01); *B41P 2215/50* (2013.01); *B65H 2404/191* (2013.01)

(56) References Cited

U.S. PATENT DOCUMENTS

| | | | | |
|---|---|---|---|---|
| 2,570,856 | A * | 10/1951 | Pratt | B05D 3/207 428/328 |
| 4,720,207 | A * | 1/1988 | Salani | B28D 1/186 172/123 |
| 6,691,615 | B2 * | 2/2004 | Fukui | H04N 1/0692 101/409 |
| 7,113,725 | B2 * | 9/2006 | Ogashiwa | G03G 15/1665 399/121 |
| 8,499,687 | B2 | 8/2013 | Gygi et al. | |
| 8,813,644 | B2 | 8/2014 | Gygi et al. | |
| 2007/0172261 | A1 * | 7/2007 | Raksha | B42D 25/369 399/266 |
| 2010/0170408 | A1 | 7/2010 | Gygi et al. | |
| 2013/0298791 | A1 | 11/2013 | Gygi et al. | |

FOREIGN PATENT DOCUMENTS

| | | | |
|---|---|---|---|
| DE | 102016204549 | A | 9/2017 |
| EP | 1810756 | A2 | 7/2007 |
| EP | 2114678 | B1 | 7/2011 |
| EP | 2845732 | B1 | 3/2017 |
| EP | 3178569 | A1 | 6/2017 |
| WO | 2014/037221 | A1 | 3/2014 |
| WO | 2016/015973 | A1 | 2/2016 |

* cited by examiner

CYLINDER, DEVICE AND MACHINE FOR ALIGNING MAGNETIC OR MAGNETIZABLE PARTICLES ON A WEB-LIKE OR SHEET-LIKE SUBSTRATE

CROSS-REFERENCE TO RELATED APPLICATIONS

This application is the U.S. National Phase, under 35 U.S.C. § 371 of PCT/EP2019/050888, filed Jan. 15, 2019; published as WO 2019/201480 A1 on Oct. 24, 2019 and claiming priority to DE 10 2018 205 885.7, filed Apr. 18, 2018, the disclosures of which are incorporated herein in their entireties by reference.

FIELD OF THE INVENTION

The present invention relates to a cylinder, a device, and a machine for aligning magnetic or magnetizable particles on a web-format or sheet-format substrate. A cylinder is used, in particular, for aligning magnetic or magnetizable particles contained in a coating medium that is applied to a first side of a web-format or a sheet-format substrate. The cylinder has, in a region of its outer circumference, a plurality of elements that induce a magnetic field; i.e. magnetic elements. The magnetic elements are arranged in or on a plurality of ring elements that are spaced apart from one another axially and that are positional in an axial direction on a shaft. In or on each ring element, a plurality of magnetic elements are, in turn, arranged one after another in circumferential direction. The device for aligning the magnetic or magnetizable particle, which are contained in a coating medium that is applied to a first side of web-format or a sheet format, includes a cylinder which is arranged in the transport path, in particular on the second side of the substrate to be conveyed, and which is embodied as a magnetic cylinder. The machine, in particular a security printing press, is provided for producing optically variable image elements on a substrate and includes a printing substrate infeed, which is, in particular embodied as a sheet feeder. At least one printing unit, has at least one printing couple, in particular, a screen printing couple, by the use of which, a substrate, that is guided along a transport path through the machine, is or can be printed at least on a first side. A product receiving unit, which is embodied, in particular, as a pile delivery, and a device for aligning magnetic or magnetizable particles, are provided in the transport path of the substrate, between the printing unit and the product receiving unit.

BACKGROUND OF THE INVENTION

A printing press known from EP 2 845 732 B1 comprises a screen printing unit and a device for aligning magnetic or magnetizable particles that are contained in the printing ink or the varnish; said device comprises a cylinder having on its circumference a plurality of elements that induce a magnetic field, along with a dryer directed toward a point along the transport path at which the substrate has not yet left the cylinder.

In EP 3 178 569 A1, substrate is coated on one side with a coating medium containing magnetic or magnetizable particles and, on the transport path downstream of the coating point, said substrate is first guided on that side over a first cylinder comprising at least one element that generates a magnetic field, and is then guided with its second side over another cylinder comprising at least one element that generates a magnetic field. As the substrate is being guided over the first cylinder, the coating is dried through a mask and through the substrate from the second side thereof.

CN 105034570 B discloses a device for producing substrate that is printed with magnetic coating medium, in which the substrate is coated on a first side by a printing device, and then is guided on said first side over a first and then a second cylinder in succession, each having elements that generate a magnetic field, after which said substrate is dried on the twice-printed side by means of a curing device, for example.

In WO 2016/015973 A1, coating medium containing magnetic or magnetizable particles is applied in one exemplary embodiment to a substrate surface; the particles are then aligned by means of a magnet provided on the second side while at the same time being dried over only a portion of the surface from the first side using a mask, after which the undried portion is aligned from the first side by means of a magnet while at the same time being dried from the second side by means of a dryer.

EP 2 114 678 B1 discloses a cylinder which, in the region of its outer circumference, comprises a plurality of elements that induce a magnetic field in or on a plurality of ring elements that are spaced apart axially and can be positioned in an axial direction on a shaft; in or on each of said ring elements, a plurality of magnetic elements are in turn arranged one after another in the circumferential direction.

EP 1 810 756 A2 discloses a device in the form of a roller for orienting magnetic flakes, in one embodiment of which said roller is formed by fitting a shaft with multiple disk-shaped magnet carriers side by side, which in turn carry multiple magnets one after another in the circumferential direction.

WO 2014/037221 A1 discloses a magnetic cylinder comprising a plurality of single-piece carrier disks arranged on a shaft, the outer circumference of said disks having a surface that comprises perforations.

SUMMARY OF THE INVENTION

The object of the present invention is to devise a cylinder, a device, and a machine for aligning magnetic or magnetizable particles on a web-format or sheet-format substrate.

The object is achieved, according to the present invention, by the provision of the cylinder having the at least two adjacent ring elements, with each such ring element having a cover element that forms a part of the cylindrical shell surface of the cylinder, and that extends in the circumferential direction, at least over the circumferential region that is equipped with the magnetic elements. The cover elements of two mutually adjacent ring elements, on the sides thereof that face one another in the axial direction, each have a plurality of protrusions alternating in the circumference direction with recesses and offset in the circumferential direction. With a relative movement of the two ring elements towards one another, the protrusions on the cover element on the one ring element can engage respectfully in a tooth-like manner in corresponding recesses of the other ring element and can overlap one another, as viewed in the circumferential direction.

The advantages that are achievable by the present invention consist, in particular, in that substrates having a particularly wide range of optically variable image elements and/or image elements of particularly high quality can be produced.

In a particularly advantageous embodiment or configuration comprising two magnetic cylinders and preferably intermediate drying, complex optically variable image elements can be produced, if desired with particularly sharp borders.

An advantageous embodiment, e.g. of modular configuration, in which one or more cylinder positions can optionally be populated by a transport cylinder and a magnetic cylinder provides a substantial increase for the operator in the spectrum of possible effects that can be produced.

A particularly advantageous solution is made possible by a device for aligning magnetic or magnetizable particles contained in a coating medium that is applied to a first side of a web-format or sheet-format substrate, said device comprising an application system arranged in the transport path of the printing substrate, by means of which the coating medium is and/or can be applied to at least one application point on the first side of the substrate, a first cylinder embodied as a magnetic cylinder, which is arranged in the transport path of the substrate to be conveyed and which, in the region of its outer circumference, has a plurality of elements that induce a magnetic field, hereinafter also referred to as magnetic elements, an additional cylinder embodied as a magnetic cylinder, which is arranged in the transport path of the substrate to be conveyed and which, in the region of its outer circumference, has a plurality of elements that induce a magnetic field, and a drying and/or curing unit, which is arranged on the transport path between the point at which the substrate runs onto the first cylinder and the point at which said substrate runs onto the additional cylinder.

In a particularly preferred embodiment of the device, the first cylinder, embodied as a magnetic cylinder, is arranged in the transport path of the substrate to be conveyed on the second side thereof, and the drying and/or curing unit is directed toward the first side of said substrate in the transport path of the printing substrate to be conveyed.

In an advantageous embodiment of the device, the additional cylinder is provided as a third cylinder downstream of a second cylinder, which is situated downstream of the first cylinder, said third cylinder being arranged in the transport path of the substrate to be conveyed on the same side of the transport path as the first cylinder.

In an advantageous configuration, the second cylinder is embodied as a transport cylinder, via which the substrate is and/or can be fed from the first cylinder to the third cylinder.

In addition to or in place of the above device, a particularly advantageous solution is made possible by a device for aligning magnetic or magnetizable particles contained in a coating medium that is applied to a first side of a web-format or sheet-format substrate, which device comprises a first cylinder embodied as a magnetic cylinder, which is arranged at a first cylinder position in the transport path of the substrate to be conveyed and which has, in the region of its outer circumference, a plurality of elements that induce a magnetic field, and a second cylinder, which follows the first cylinder at a second cylinder position in the transport path and which is arranged on the other side of the transport path from the first cylinder.

In a particularly preferred embodiment of the device, the first cylinder provided at the first cylinder position, the second cylinder, and a third cylinder that follows the second cylinder at a third cylinder position in the transport path are or can be rotatably mounted in frame walls of a frame, the second cylinder being embodied, in particular, solely as a transport cylinder, i.e. without magnetic elements on its circumference.

In a particularly advantageous refinement, the bearing means for receiving the journals of the cylinder to be arranged at the third position are configured such that the third cylinder position can optionally be equipped and/or configured with a magnetic cylinder corresponding to the first cylinder and having a plurality of elements that induce a magnetic field or with a transfer cylinder that corresponds to the second cylinder, and/or the bearing means for receiving the journals of the cylinder to be arranged at the first position are configured such that the first cylinder position can optionally be equipped and/or configured with a transfer cylinder that corresponds to the second cylinder, rather than with the magnetic cylinder.

In a particularly advantageous embodiment of the device, the third cylinder position is equipped and/or configured with a cylinder embodied as a magnetic cylinder, which has, in the region of its outer circumference, a plurality of elements that induce a magnetic field. In an alternative configuration, the third cylinder position can be equipped and/or configured with a cylinder embodied as a transfer cylinder.

The bearing means embodied for receiving either a magnetic cylinder or a transfer cylinder are preferably configured as having radial bearings for receiving journals of the same diameter for the cylinders configured as either magnetic or transfer cylinders, and/or on the frame at the relevant cylinder positions are configured as having receiving means for receiving radial bearings of the same outer diameter for the magnetic and transfer cylinders.

The first cylinder is preferably arranged in the transport path of the substrate to be conveyed, in each case on the second side of said substrate.

In an embodiment of a cylinder that is particularly preferred on its own or in conjunction with a device as described above, in particular a cylinder for aligning magnetic or magnetizable particles contained in a coating medium that is applied to a first side of a web-format or sheet-format substrate, and which cylinder has, in the region of its outer circumference, a plurality of elements that induce a magnetic field, i.e. magnetic elements, the magnetic elements are arranged in or on a plurality of ring elements that are spaced apart from one another axially and are positionable in an axial direction on a shaft, in or on each of which ring elements a plurality of magnetic elements are in turn arranged one after another in the circumferential direction.

In an advantageous embodiment of an aforementioned device, the cylinders comprise holding means for transporting the substrate in the form of printing substrate sheets, wherein the substrate in the form of printing substrate sheets is transferred directly between the mutually adjacent cylinders.

In an advantageous embodiment, a chain gripper system having gripper bars supported by continuous revolving chains is provided in the transport path between the application system and the first cylinder.

A first drying and/or curing unit provided, e.g., in an aforementioned device is preferably configured to act on the substrate to be treated in sections that are spaced apart from one another transversely to the direction of transport and/or said unit is directed toward a point on the transport path lying on the circumference of the first cylinder. Said sections are preferably adjustable in terms of their position transversely to the direction of transport and/or from which the drying and/or curing unit comprises a plurality of radiation sources, preferably UV radiation sources such as UV LED's in particular, which are provided in a plurality of dryer heads that define the sections or in an array of radiation sources that is continuous over the maximum substrate width to be treated but that can be activated in sections.

A second drying and/or curing unit provided, e.g., in an aforementioned device preferably comprises a plurality of radiation sources, preferably UV radiation sources such as UV LED's in particular, which are provided in an array of radiation sources that is continuous over the maximum substrate width to be treated.

In a particularly preferable embodiment of the cylinder, at least two adjacent ring elements, preferably all ring elements, each have a cover element that forms a part of the cylindrical shell surface of the cylinder and that extends in the circumferential direction at least over the circumferential region that is equipped with the magnetic elements, wherein the cover elements of two mutually adjacent ring elements each have, on the axially facing sides thereof, a plurality of protrusions alternating in the circumferential direction with recesses and offset in the circumferential direction such that, with a relative movement of the two ring elements toward one another, the protrusions on the cover element of the one ring element engage respectively in a tooth-like manner in corresponding recesses of the other ring element and can overlap one another as viewed in the circumferential direction.

A preferable machine, in particular a security printing press, for producing optically variable image elements on a substrate, comprising a printing substrate infeed, in particular embodied as a sheet feeder, at least one printing unit having at least one printing couple, in particular a screen printing couple, is provided by means of which a substrate that is guided along a transport path through the machine is and/or can be printed at least on a first side. A product receiving unit, embodied in particular as a pile delivery, and a device for aligning magnetic or magnetizable particles, as described by one of the aforementioned embodiments or variants and/or an embodiment or variant described in the specifications are provided in the transport path of the substrate between the printing unit and the product receiving unit.

Further details and variants may be found in the following exemplary embodiments and may be combined respectively with any of the embodiments set out above for the device, the cylinder, and/or the machine, provided said combination is not contradicted.

BRIEF DESCRIPTION OF THE DRAWINGS

Exemplary embodiments of the invention are illustrated in the set of drawings and will be described in greater detail below.

In the drawings.

Figure 1:
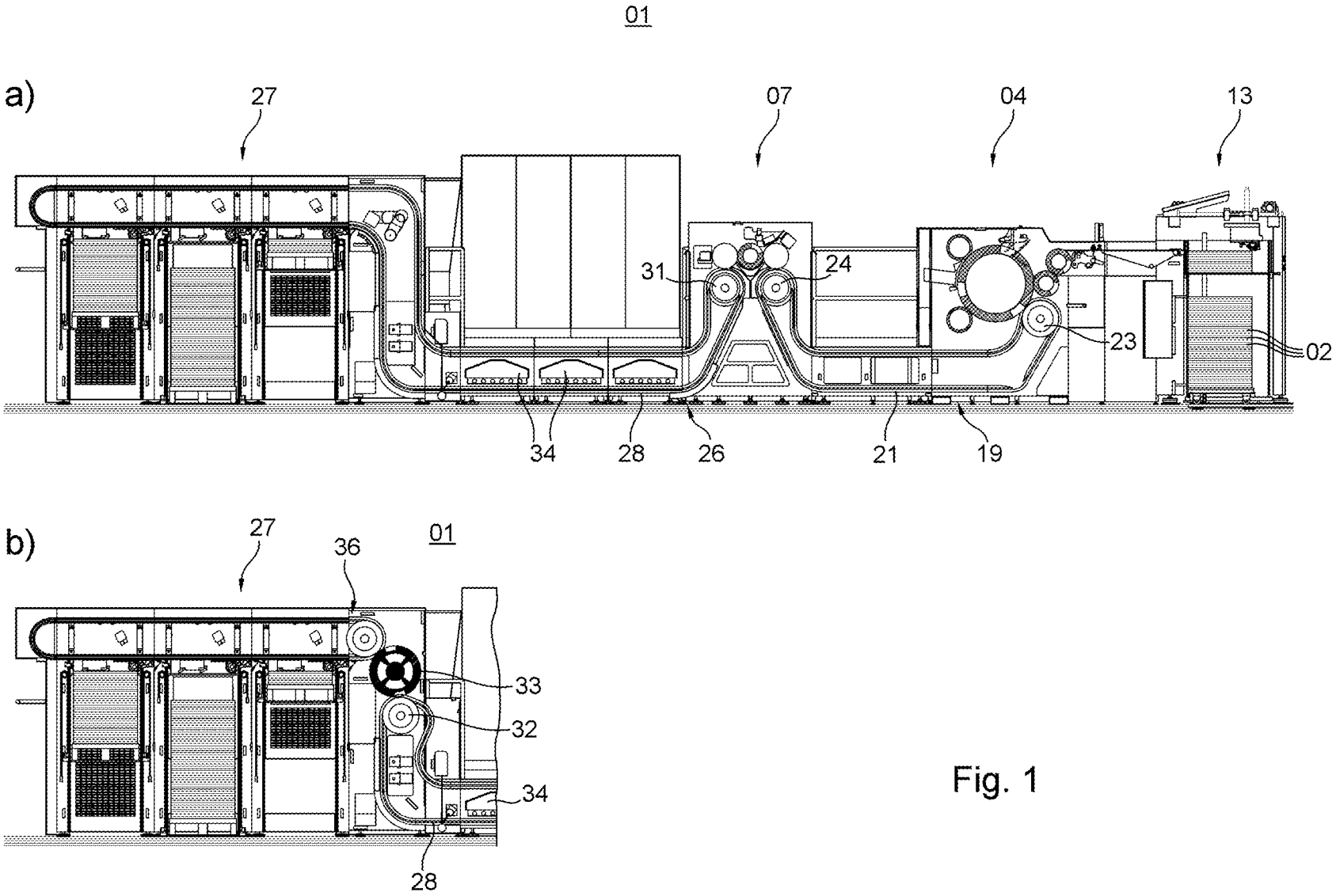
FIG. 1 shows an exemplary embodiment of a machine for producing optically variable image elements on a substrate in the first variant a) and in an advantageous variant b)

A machine 01, e.g. a printing press 01, in particular a security printing press 01, for producing optically variable image elements 03 on a substrate 02, e.g. a web-format or sheet-format printing substrate 02, comprises an application system 04, e.g. a printing unit 04, by means of which optically variable coating medium 06, e.g. optically variable printing ink 06 or varnish 06, can be applied to least one application point, e.g. printing point, on at least a first side of the substrate 02, e.g. the printing substrate 02, over the entire surface or in sub-regions thereof, in the form of print elements 08, and comprises a device 07 for aligning the optically variable effect in the image elements 03 by orienting the particles responsible for the optical variability, which are contained in the optically variable coating medium 06 that is applied to the substrate 02 (see, e.g., FIG. 1). In the following, said device 07 is also referred to simply as the alignment device 07.

Figure 2:
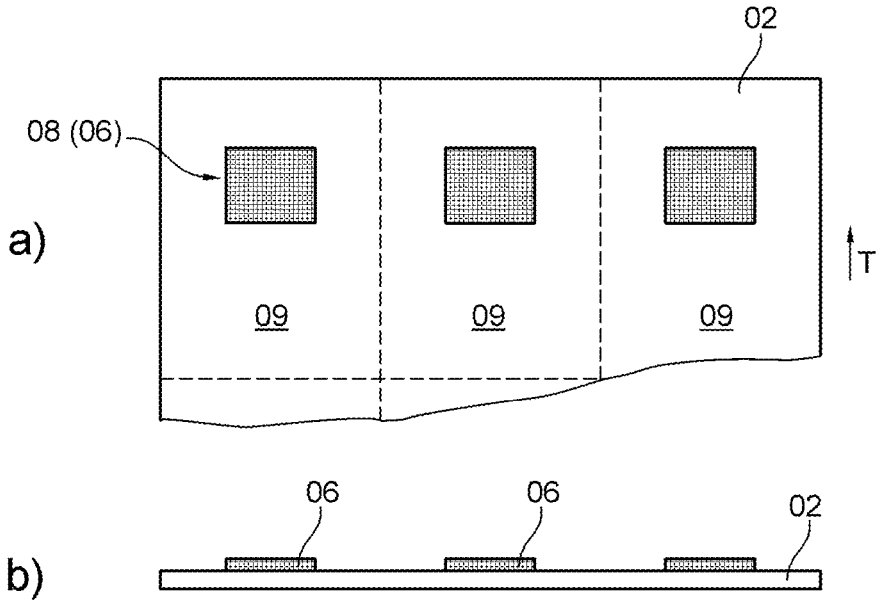
FIG. 2 is a schematic depiction of a substrate printed with optically variable coating medium in print elements.
Figure 3:
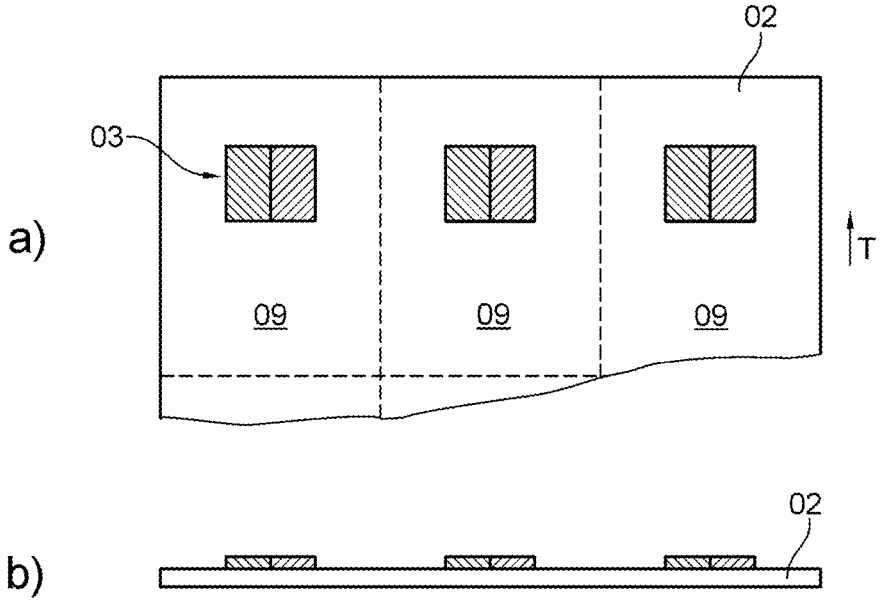
FIG. 3 is a schematic depiction of a substrate furnished with optically variable image elements.

The print elements 08 composed of variable coating medium 06, which are applied to the substrate 02 by the application system 04 prior to treatment by the alignment device 07, may correspond in size and position to the optically variable image elements 03 to be produced (see, e.g., FIGS. 2 and 3) or may optionally be larger than this, if applicable even extending over the surface of multiple copies 09. In the case of larger print elements 08, an optically variable image element 03 is not produced, for example, by means of alignment over the entire surface coated with the optically variable coating medium 06.

The particles responsible for optical variability here are magnetic or magnetizable, non-spherical particles, e.g. pigment particles, hereinafter also referred to simply as magnetic flakes, contained in the coating medium 06, e.g. the printing ink 06 or the varnish 06.

The machine 01 is preferably configured for producing copies 09, e.g. securities 09, in particular banknotes 09, or for producing intermediate products used for such securities 09, e.g. print images of multiple printing substrate sections containing such securities 09. The substrate 02, e.g. printing substrate 02, may be in the form of paper, e.g. cellulose-based or preferably cotton fiber-based paper, a plastic polymer, or a hybrid product of these. Before being coated in the aforementioned application system 04, said printing substrate may be uncoated or may already have been coated, it may be unprinted or may already have been printed one or more times, or otherwise mechanically processed. On a longitudinal section of web-format substrate 02 or on a sheet of a sheet-format substrate 02, multiple copies 09, e.g. banknotes 09 to be produced, preferably are or are to be arranged in a row side by side, and multiple such rows of copies 09 or the printed image thereof preferably are or are to be arranged one after another in the direction of transport T, during the course of processing of the substrate 02 (see, e.g., FIG. 2 and FIG. 3).

The machine 01 embodied as a printing press 01 can generally comprise one or more printing units 04 having one or more printing couples of any printing method. In a preferred embodiment, however, said machine comprises a printing unit 04 having at least one printing couple 11; 12 that operates according to the flexographic printing method or preferably according to the screen printing method, by means of which the optically variable coating medium 06 is or can be applied to a first side of the printing substrate 02. The aforementioned printing methods, in particular the screen printing method, allow a thicker layer to be applied than is possible with other printing methods. The term the "first side" of the substrate 02 or printing substrate 02 has been chosen arbitrarily and is intended to denote the side of the printing substrate 02 to which the optically variable coating medium 06 is or has been or may be applied.

Figure 4:
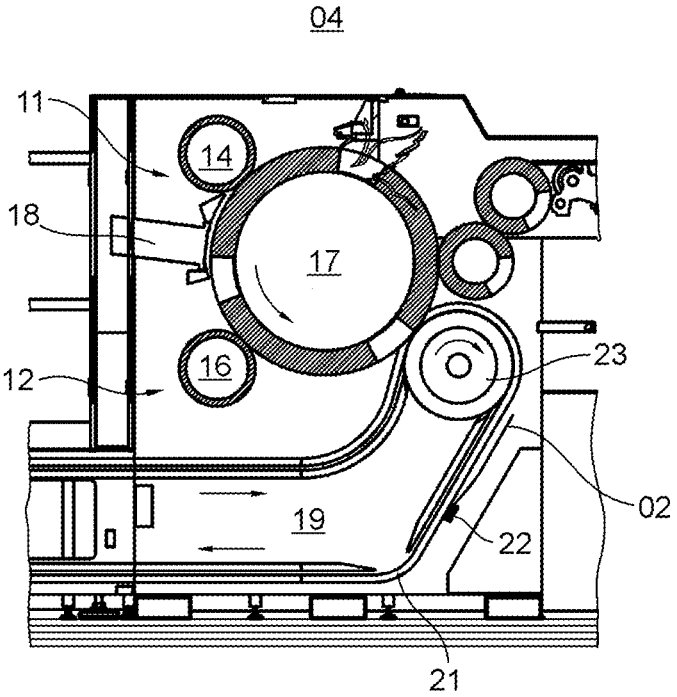
FIG. 4 shows an enlarged view of the printing unit from FIG. 1.
Figure 5:
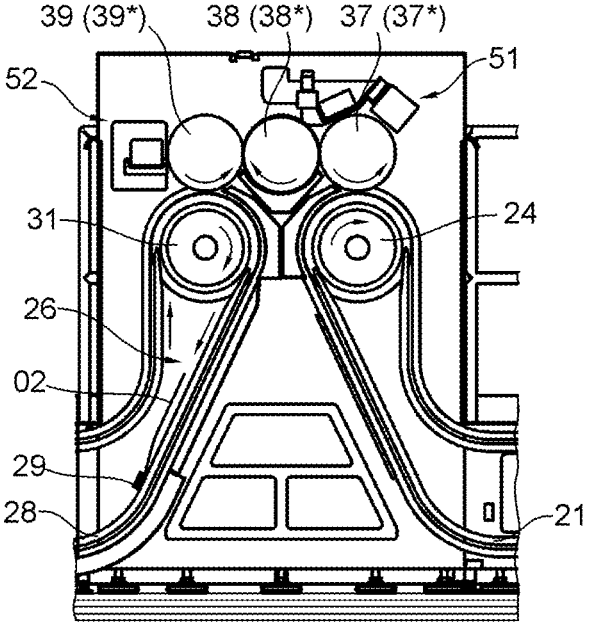
FIG. 5 shows an enlarged view of the device for aligning magnetic or magnetizable particles from FIG. 1.
Figure 6:
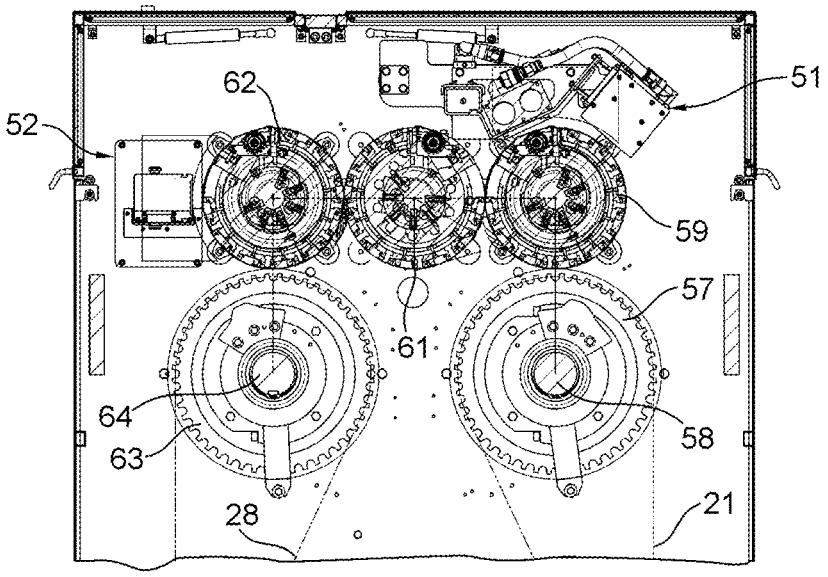
FIG. 6 shows a side view into the open side of a device for aligning magnetic or magnetizable particles.
Figure 7:
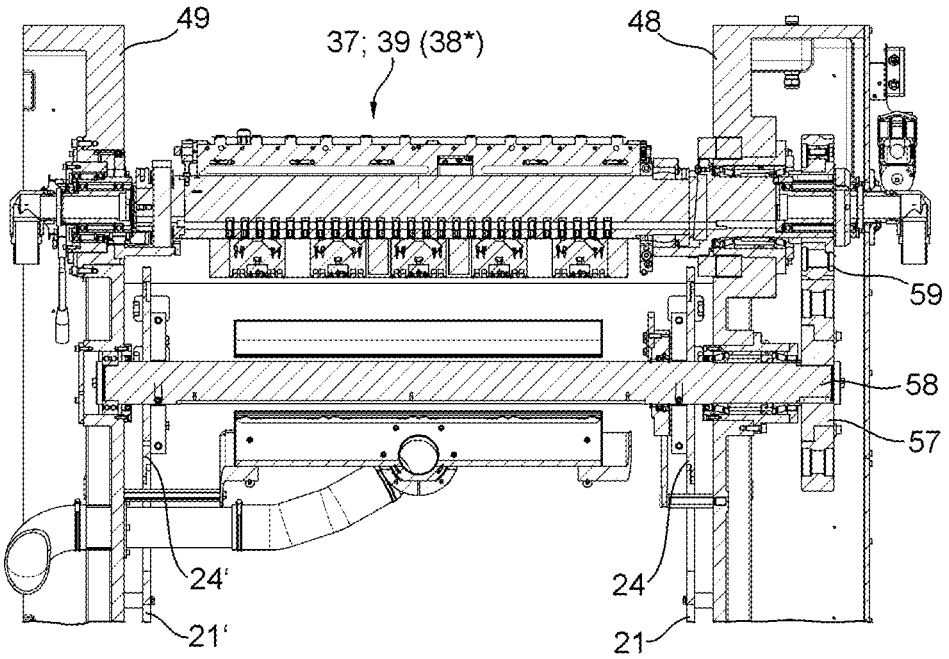
FIG. 7 shows a vertical section, transversely to the direction of transport, of the device according to FIG. 6.

In the depicted and preferred embodiment, the printing press 01 comprises a printing substrate infeed 13, e.g. a roll unwinder 13 or preferably a sheet feeder 13, by which the web-format or preferably sheet-format printing substrate 02 is or can be fed, optionally via additional printing or processing units, to the printing unit 04, e.g. the flexographic or more particularly the screen printing unit 04, having at least one printing couple 11; 12, e.g. a flexographic or more particularly a screen printing couple 11; 12, which applies the optically variable coating medium 06. In the depicted and advantageous embodiment, two screen printing couples 11; 12 are provided, which are preferably combined in the same printing unit 04 and each of which forms, between a forme cylinder 14; 16, e.g. a screen printing cylinder 14; 16, and a shared impression cylinder 17, two printing points for the same side of the printing substrate 02, in this case the first side (see, e.g., FIG. 4). In the transport path between the two printing points, a drying and/or curing unit 18, e.g. a UV dryer 18, can be provided, which is directed toward the first side of a printing substrate 02 to be conveyed through the printing unit 04. One or both of the screen printing couples 11; 12 may apply or be capable of applying optically variable coating medium 06.

From the printing unit 04 that applies the optically variable coating medium 06, the printing substrate 02 can be fed via conveying means of a first conveyor system 19 to the alignment device 07. In the case of web-format printing substrate 02, said means may be one or more positively driven or non-driven rollers, via which the printing substrate 02 is or can be guided into the alignment device 07 on the input side thereof. In the preferred case of sheet-format printing substrate 02, i.e. individual printing substrate sheets 02 that pass through the machine 01, said conveying means are provided in the form of sheet-conveying means.

In an embodiment not shown here, said sheet-conveying means may be formed by one or more transfer cylinders or drums that receive the printing substrate sheet 02 from the printing unit 04, e.g. from the impression cylinder 17, and deliver it to the alignment device 07 on the input side thereof, optionally via one or more additional transfer cylinders or drums. Preferably, however, the first conveyor system 19 is embodied as a revolving gripper conveyor 19, e.g. what is known as a chain gripper system 19, which comprises continuous pulling means 21, e.g. continuous chains 21, revolving on both sides of the frame and carrying gripper bars 22 that extend transversely to the direction of transport. The gripper bars 22 can grip the leading ends of the sheets and can thus transport printing substrate sheets 02 along the conveying path and deliver said sheets to the corresponding conveying or receiving means at the intended location. A sprocket 23; 24, also called a chain gripper wheel 23; 24, is preferably located at least in the region where the printing substrate sheet 02 is received from the printing unit 04 and in the region where said sheet is delivered to the alignment device 07.

After passing through the alignment device 07, which will be described in greater detail below, the printing substrate 02 can be guided via conveying means of an additional, e.g. second conveyor system 26 to a product receiving unit 27 for receiving the printing substrate 02 that has been treated and/or processed in the machine 01, e.g. a winder 27 in the case of web-format substrate 02 or a pile delivery 27 in the preferred case of sheet-format substrate 02. In the case of web-format printing substrate 02, said conveying means can again be one or more positively driven or non-driven rollers that carry the transport path of the first conveyor system 19 forward and through the alignment device 07 and via which the printing substrate 02 is or can be guided into the winder 27 on the input side thereof. In the preferred case of sheet-format printing substrate 02, the conveying means are provided in the form of sheet-conveying means. As above, said sheet-conveying means may be in the form of one or more transfer cylinders or drums, which receive the printing substrate sheet 02 from the alignment device 07 and deliver it to the pile delivery 27 downstream. Preferably, the second conveyor system 26, like the first, is configured as a revolving gripper conveyor 26, e.g. a chain gripper system 26 having revolving continuous pulling means 28, e.g. continuous chains 28, one or more sprockets 31; 32 or chain gripper wheels 31; 32, and gripper bars 29, by means of which the printing substrate sheets 02 are received from the transport path section of the alignment device 07 and are fed, e.g., to the pile delivery 27 (see, e.g., FIG. 1, variant a)). On the transport path leading away from the alignment device 07, an additional drying unit having one or more dryers 34, e.g. radiation dryers 34, directed toward the first side of the printing substrate 02 may be provided. In an advantageous refinement, a cooling unit 33 is provided on the transport path between alignment device 07 and pile delivery 27, in particular downstream of the additional drying unit in the transport path between alignment device 07 and receiving unit 27 (see, e.g., FIG. 1, variant b)). Said cooling unit may be embodied, for example, as a cooling roller 33, which is located between the second conveyor system 26 coming from the alignment device 07 and a third conveyor system 36, e.g. likewise embodied as a revolving gripper conveyor 36, e.g. as a chain gripper system 36. In a further refinement, an inspection unit (not shown), e.g. a surface or line camera, can be provided and can be directed, for example, toward a lateral surface segment of the cooling roller 33 that lies in the transport path.

The alignment device 07 detailed below is generally unrestricted in terms of its embodiments, variants, and configurations, however it preferably is or can be provided in a machine 01 or printing press 01 as described above. In one advantageous embodiment, it is configured in the manner of a module and can be integrated into the transport path of the machine 01 that is to be equipped using interfaces, on the input and output sides, to the open section ends of a conveyor system that continues upstream and downstream.

The device 07 for aligning optically variable image elements 03, e.g. for aligning the optically variable effect in the optically variable coating medium 06 applied previously, e.g. in the form of print elements 08, to the substrate 02, in particular the printing substrate 02, comprises a defined transport path along which the substrate 02 to be conveyed through the alignment device 07 is guided or conveyed in a defined manner from an input region, in which the substrate

02 to be treated, which has the optically variable coating medium 06 on its first side, is or can be fed in past the active components 37; 38; 39; 37*; 38*; 39*; 51; 52 and into an output region. Said first side that has the optically variable coating medium 06 is understood in particular as the side on which the optically variable coating medium 06 is or will be applied or has been applied upstream, for example, in the transport path through the application system 04.

As active components 37; 38; 39; 37*; 38*; 39*, a group of cylinders 37; 38; 39; 37*; 38*; 39* is provided, comprising at least one first cylinder 37; 37* and downstream thereof a second cylinder 38; 38*, which are arranged on different sides of a substrate 02 to be conveyed along the transport path. Said first cylinder 37; 37* is arranged in the transport path of the substrate 02 to be conveyed, on the second side thereof, so that the first side of said substrate, which is coated with optically variable coating medium 06, faces outward during transport of said substrate via the first cylinder 37; 37*. In a preferred embodiment, a third cylinder 39; 39* is provided downstream, arranged on the same side of the transport path as the first cylinder 37; 37*.

In an embodiment or configuration of the alignment device 07 that is referred to here as the basic embodiment or configuration, the first cylinder 37 has, in the region of its outer circumference, a plurality of elements 41 that induce a magnetic field, hereinafter also referred to simply as magnetic elements 41, which serve to orient at least a portion of the magnetic or magnetizable particles of the coating medium 06 applied to the passing printing substrate. In the case of the aforementioned plurality of copies 09 per substrate section or substrate sheet 02, a plurality of rows of magnetic elements 41 are provided over said circumference, spaced apart from one another transversely to the direction of transport, which correspond, when wound off onto the substrate 02, with the pattern of image elements 03 on the substrate 02 that are to be exposed to magnetic fields. The cylinder 37 comprising the magnetic elements 41 is also referred to in the following as a magnetic cylinder 37. With the aforementioned guidance of the substrate 02 in such a way that the first side of said substrate faces outward as it is being transported via the first cylinder 37, the particles are aligned or oriented through the substrate 02 by means of the magnetic elements 41. In this basic embodiment or configuration, the second cylinder 38 is embodied merely as a transport cylinder 38, i.e. without magnetic elements in the region of its outer circumference.

Figure 12:
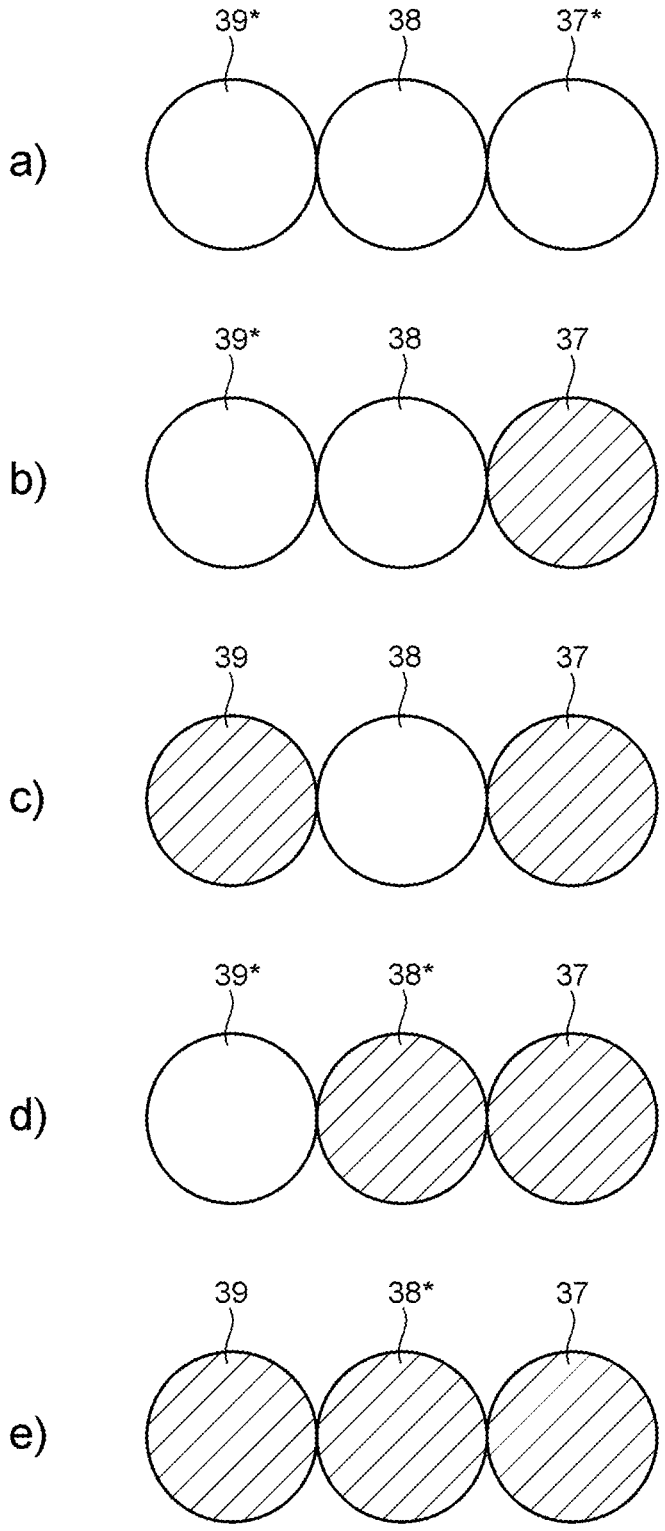
FIG. 12 is a schematic depiction of various embodiments or configurations of a magnetic cylinder.

In the preferred case in which the alignment device 07 comprises a third cylinder 39 downstream of the second cylinder 38, in the basic embodiment or configuration the third cylinder 39* is also embodied merely as a transport cylinder 39*, i.e. without magnetic elements in the region of its outer circumference (see, e.g., FIG. 12*b*).

In a particularly advantageous embodiment or configuration of the three-cylinder configuration, the third cylinder 39 of the alignment device 07 is likewise embodied as a magnetic cylinder 39 and has, as described above in reference to the first magnetic cylinder 37, a plurality of elements 42 that induce a magnetic field in the region of its outer circumference, hereinafter also referred to simply as magnetic elements 42, for orienting at least a portion of the magnetic or magnetizable particles of the coating medium 06 applied to the passing printing substrate 02. The magnetic elements 42 can be arranged on the circumference of the second magnetic cylinder 39 in the same pattern as those of the first magnetic cylinder 37. In that case, the position of said magnetic elements with respect to their location as they are rolled out onto a substrate 02 that is being conveyed along the transport path through the alignment device 07 may coincide with the positions of the first magnetic elements 41, or said magnetic elements may all be offset in the same manner in a circumferential and/or axial direction, for example, from the positions of the first magnetic elements 41. The dimensions of an offset in the respective position may be, for example, such that as they are rolled out onto the substrate 02, the surfaces of the first and second magnetic elements 41; 42 that face the substrate 02 still overlap, continuing in a straight line on one side or spaced from one another slightly, i.e. by no more than half of their extension in the relevant direction. In the case of an offset, they can then act offset from one another on the relevant print element 08. In addition to or in place of the offset, the first and second magnetic elements 41; 42 may also be configured and/or oriented differently, so that they induce field lines that differ from one another in terms of direction and/or pattern in the respective plane of a substrate 02 to be treated.

In the case of web-format substrate 02, a cylinder 37; 38*; 39 embodied as a magnetic cylinder 37; 38*; 39 may be embodied without any holding means acting on the substrate 02. Optionally, suction air openings may be provided on the cylinder circumference, which are connected to a vacuum pump and which ensure that the substrate 02 rests securely on the lateral surface. For the preferred case here of sheet-format substrate 02, holding means 43, e.g. grippers 43 of what is known as a gripper bar, are preferably provided on the circumference of the cylinder 37; 38*; 39, said holding means preferably being capable of receiving the leading end of a substrate sheet 02 to be conveyed via the cylinder 37; 38*; 39 and of holding said sheet over an angular range during a rotation of the cylinder 37; 38*; 39. Suction air openings that are connected via lines to a vacuum pump may additionally be provided on the circumference. Although a magnetic cylinder 37; 38*; 39 of this type likewise serves to transport the substrate 02, in the context of its fitting with the aforementioned magnetic elements 41; 42 it not regarded or referred to here as a transport cylinder. The magnetic elements 41; 42 can be arranged or arrangeable in or on a plurality of ring elements 44, e.g. between four and seven, in particular between four and six, which are spaced axially from one another and can preferably be positioned in the axial direction, with at least one, preferably a plurality of magnetic elements 41; 42, e.g. between two and twelve, advantageously between five and ten, in turn being arranged or arrangeable in or on said ring elements 44, one after another in the circumferential direction and preferably positionable in the circumferential direction (see, e.g., FIG. 10).

Elements 41; 42 that induce a magnetic field, or magnetic elements 41; 42, are understood here as any magnetically active elements that permanently or switchably induce, at least toward the side of the transport path, a magnetic field (of sufficient strength particularly for the alignment of particles contained in the coating medium 06 on the substrate 02 that is guided over said path, as described here). Said magnetic elements 41; 42 may be in the form of permanent magnets with or without engraving, solenoids, or combinations of multiple permanent magnets and/or solenoids. They can be arranged operationally fixed or moved or movable on the operationally ready cylinder 37; 38*; 39.

Figure 11:
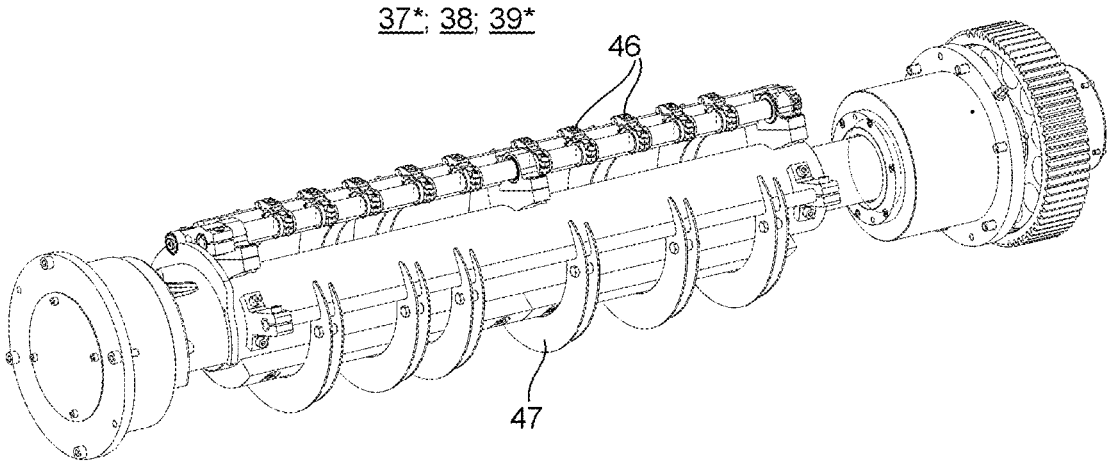
FIG. 11 shows an oblique view of an embodiment of a transport cylinder.

In the case of web-format substrate 02, a cylinder 37*; 38; 39* embodied (here in particular solely) as a transport cylinder 37*; 38; 39* has, e.g., a cylindrical lateral surface that is or will be wrapped at least partially by the web-format substrate 02 to be guided along the transport path. In the preferred case of sheet-format substrate 02, preferably provided on the circumference of the transport cylinder 37*; 38;

39* are holding means 46, e.g. grippers 46 of what is known as a gripper bar, by means of which a substrate sheet 02 to be conveyed via the cylinder 37*; 38; 39* is or can be received at its leading end, and is or can be held over an angular range during rotation of the transport cylinder 37*; 38; 39*. It is not essential for the cylinder 37*; 38; 39* designated as a transport cylinder 37*; 38; 39* to have a predominantly closed outer cylinder surface; on the contrary, in extreme cases it can merely comprise at least one gripper bar, spaced on a cylindrical shell surface and rotating around the cylinder axis. To avoid the formation of chords during transport of the substrate sheets 02, however, additional axially extending crosspieces and/or axially spaced support disks or support rings 47 may be provided (see, e.g., FIG. 11).

Each of the two or preferably three cylinders 37; 38; 39; 37*; 38*; 39* is rotatably mounted at its end faces in frame walls 48; 49, e.g. side sections 48; 49 of a frame that supports the components of the alignment device 07.

In a particularly advantageous embodiment, in particular the bearing means (if provided) that receive the journals of the cylinder 39; 39* to be arranged at the third position and/or, for example, the bearing means of the cylinder 38; 38* to be arranged at the second position as viewed in the direction of transport T are configured such that the respective cylinder position can be equipped with either a magnetic cylinder 38*; 39 or a transfer cylinder 38; 39*. In an advantageous refinement, the bearing means for receiving the journals of the cylinder 37; 37* to be arranged at the first position are also configured such that the first cylinder position of the group of cylinders 37; 38; 39; 37*; 38*; 39*, as viewed in the direction of transport T, can also be equipped with either a magnetic cylinder 37 or a transfer cylinder 37* (see, e.g., FIG. 12).

This can be achieved, for example, in that magnetic cylinders and transfer cylinders 37; 38*; 39; 37*; 38; 39* are provided with journals of the same diameter, and said journals can be arranged in radial bearings of the same inside diameter that are or are to be seated in the side sections 48; 49 for the relevant cylinder positions, and/or in that, for receiving the journals of the magnetic and transfer cylinders 37; 38*; 39; 37*; 38; 39*, radial bearings having the same outside diameter are provided in each case, which can be seated in receiving means provided for the relevant cylinder positions on the frame, e.g. openings or bearing shells having the same inside diameter, provided in the side sections 48, 49. The latter can be provided directly by the inside width of a frame bore provided in the side section 48; 49 or by the inside width of a bearing ring, e.g. an eccentric adjustment ring, additionally provided in such a frame bore. In an advantageous embodiment, the journals and the bearing configuration for the two different types of cylinders 37; 38; 39; 37*; 38*; 39* in the at least two, preferably three, cylinder positions of the cylinder group comprised by the alignment device 07 are identical.

The three cylinders 37; 38; 39; 37*; 38*; 39* or the bearings thereof are preferably provided in the frame in such a way that the three cylinder axles lie substantially in a common plane, for example a horizontal plane. In that case, there should be no distance between the axle of the central cylinder 38; 38* and the connecting plane through the axles of the two outer cylinders 37; 39; 37*; 39*, or at most a maximum distance of no more than 30 mm, preferably no more than 10 mm.

As a further active component 51 on the transport path of the substrate 02, in particular printing substrate 02, to be conveyed through the alignment device 07, at least one first drying and/or curing unit 51 preferably is or can be arranged on the first side of said substrate, which has the optically variable coating medium 06. Said unit is directed, as viewed in the direction of transport T, toward a lateral surface segment of the first cylinder 37, e.g. embodied as a magnetic cylinder 37, or toward a point on the transport path along which the substrate 02 to be conveyed is guided during operation, in particular with its second side, on the first cylinder 37; 37* embodied, e.g., as a magnetic cylinder 37. With the aforementioned guidance of the substrate 02 in such a way that its first side faces outward during transport of said substrate via the first cylinder 37; 37*, direct drying or curing of at least an outer layer of coating medium 06 that is applied to the substrate 02 takes place. The point, as viewed in the direction of transport T, toward which the first drying and/or curing unit 51 is directed is preferably located at least 90° behind the point at which the substrate 02 to be conveyed along its transport path runs onto the first cylinder 37; 37* and in front of the point at which the substrate 02 to be conveyed along its transport path via the first cylinder 37; 37* leaves the first cylinder 37; 37*. Said drying and/or curing unit 51 is preferably embodied as a radiation dryer, which operates on the basis of electromagnetic radiation, e.g. with IR or preferably UV radiation. For this purpose, it comprises one or more radiation sources, e.g. IR or preferably UV light sources.

In a preferred embodiment of the aforementioned first drying and/or curing unit 51, said unit is configured to act, in at least one operating mode, on the substrate 02 to be treated in sections that are spaced apart from one another rather than continuously over the entire width of said substrate. Said sections are preferably adjustable in terms of their position transversely to the direction of transport of the substrate 02, and the respective effective width of said sections can optionally be defined.

Figure 8:
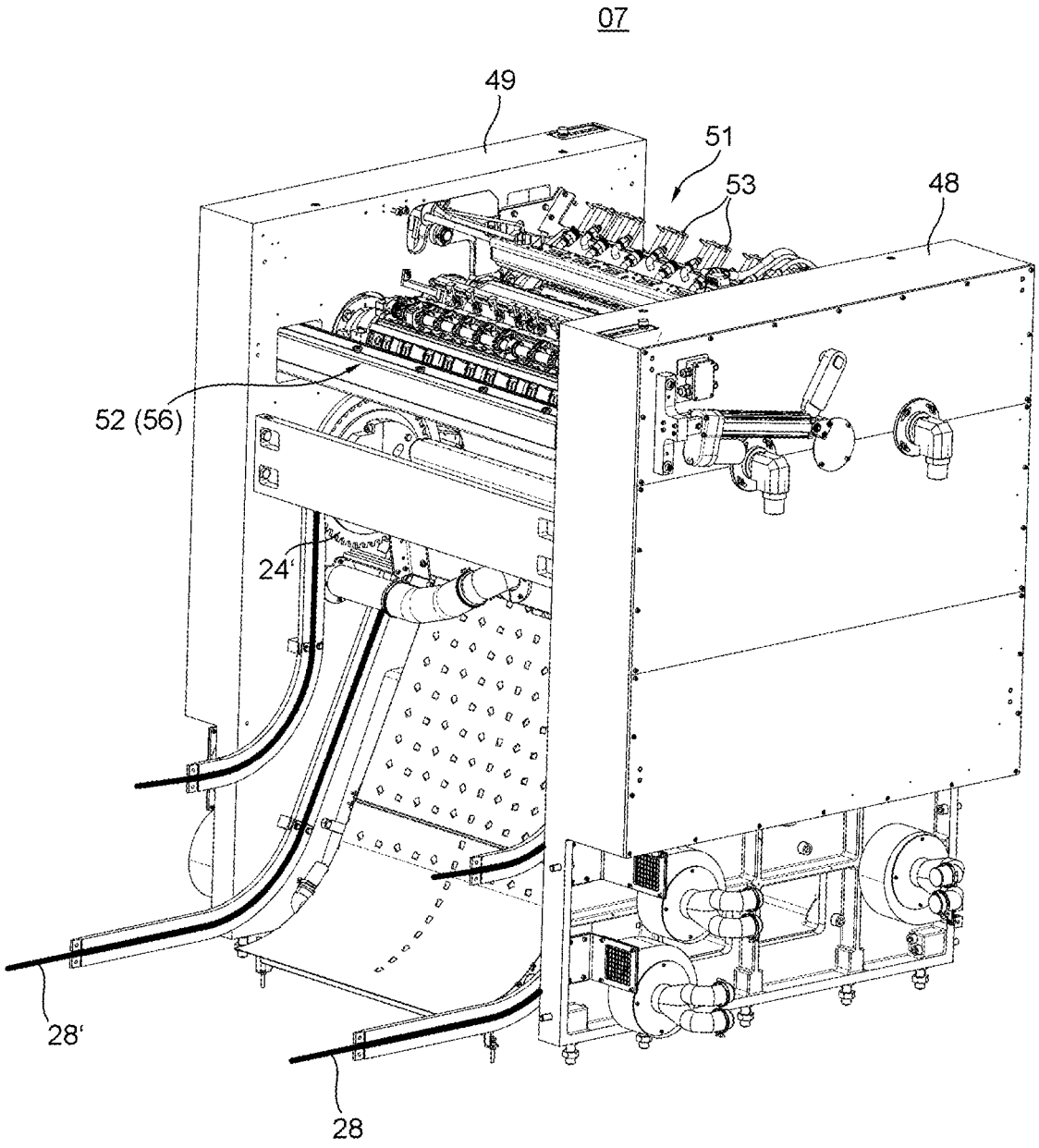
FIG. 8 shows an oblique view of the device for aligning magnetic or magnetizable particles with a first variant of the first drying and/or curing unit.

In a first variant (see, e.g., FIG. 8), the drying and/or curing unit 51 can comprise a plurality of dryer elements and/or curing elements 53, e.g. dryer heads 53, e.g. between four and seven, in particular between four and six, arranged side by side transversely to the direction of transport T and directed toward the transport path, which are preferably variable in terms of their position transversely to the direction of transport T. The dryer heads 53 are preferably embodied as radiation dryer heads 53 and can each comprise one or more radiation sources, e.g. IR or preferably UV radiation sources. In an advantageous embodiment, the dryer heads 53 each comprise a plurality of radiation sources (e.g. more than 10) configured as LED's, e.g. IR LED's or preferably UV LED's, which are arranged at the head end of the respective dryer head 53, for example in the manner of a one-dimensional or preferably a two-dimensional array. The dryer heads 53 are arranged, for example, on a crossbar and are preferably movable transversely on said crossbar, thus enabling their position to be adjusted.

In an advantageous refinement, the drying and/or curing unit 51 that comprises the crossbar and the dryer heads 53 is embodied as a structural unit, e.g. a module, and as such can be installed in or on the side sections 48; 49 of the frame and removed therefrom. The side sections 48; 49 of the frame have, e.g., connection elements or connection points furnished accordingly for this purpose. In an embodiment or configuration in which the first cylinder 37* is configured as a transport cylinder 37*, the first drying and/or curing unit 51 may be omitted or may be removed during retooling.

In a refinement of the first variant that is especially advantageous particularly in connection with the present production of optically variable image elements 03, at least one masking element (not shown here) and one fastening mechanism are provided per dryer element and/or curing element 53, said fastening mechanism being intended for positioning the masking element in the radiation path between the dryer element and/or curing element 53 and the transport path so as to effect a defined limitation of the irradiated area in the plane of the transport path in relation to the irradiated area during operation without masking. Masking elements of different sizes can be provided for the purpose of different degrees of shading, and/or the masking element can be movable with at least one component transversely to the beam direction in relation to the dryer and/or curing element 53.

Figure 9:
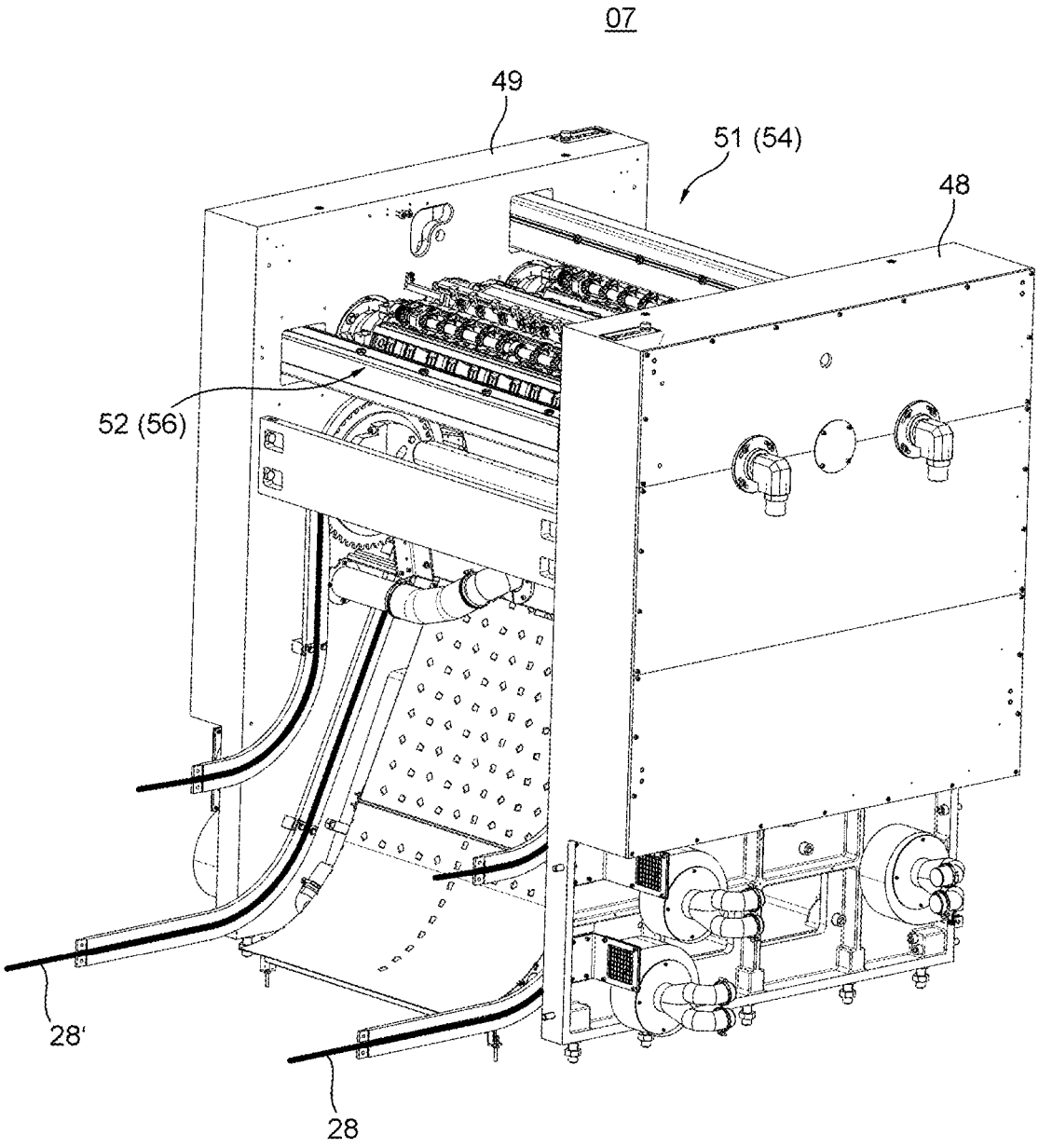
FIG. 9 shows an oblique view of the device for aligning magnetic or magnetizable particles with a second variant of the first drying and/or curing unit.

In a second variant that is particularly advantageous with respect to its variability (see, e.g., FIG. 9), the drying and/or curing unit 51 can be a dryer element and/or curing element 54 that extends, in particular in the form of a beam, e.g. in the manner of a light bar 54, in particular an LED light bar, transversely to the direction of transport T over at least the width of the maximum substrate width to be treated in the device 07, and that comprises a plurality, in particular a multiplicity, of radiation sources, e.g. IR or preferably UV radiation sources, e.g. more than 100, arranged immediately side by side transversely to the direction of transport T, i.e. spaced at least by less than 5 mm, in particular at least by less than 2 mm from one another the transverse direction. Said radiation sources can preferably be configured as LED's, e.g. IR LED's or preferably UV LED's, and can be arranged, for example, in a one-dimensional or preferably a two-dimensional array. The light sources can be arranged in or on a one-part or multi-part frame section, for which, in contrast to the dryer element and/or curing element 53 from the first variant, no axial mobility is provided to allow adjustment of the intended beam position. The aforementioned sections in which the substrate 02 is to be acted on are or are to be formed by groups of active radiation sources or radiation sources that are to be activated, between which are groups of inactive light sources or light sources that are not to be activated. The position and preferably the width of the sections can be varied by defining those radiation sources that are active or are to be activated. Groups of radiation sources may be fixedly defined in advance and selectable only as belonging to the active or inactive groups. In an even more variable embodiment, the positions and widths of the sections can be defined by the formation of groups of radiation sources or sub-groups of radiation groups that are to be activated. Although this variant already provides good resolution between the area to be irradiated and the area not to be irradiated, it is also possible for mask elements to be provided, which are positioned in a manner comparable to the first variant in the radiation path between dryer and/or curing element 54 and transport path in such a way that the irradiated area in the plane of the transport path can be even more limited as compared with the irradiated area during operation without masking, for example by blocking residual diffuse beam portions. In this case as well, mask elements of different sizes and/or a relatively movable arrangement may be provided.

In an advantageous refinement of a second variant, the drying and/or curing unit 51 is embodied as a structural unit or module and as such can be installed in its entirety in or on the frame walls or side sections 48; 49 of the frame and removed therefrom, in which case the side sections 48; 49 of the frame have, e.g. connection elements or connection points, furnished accordingly for this purpose. In an embodiment or configuration in which the first cylinder 37* is configured as a transport cylinder 37*, the first drying and/or curing unit 51 may be omitted or may be removed during retooling.

In cases in which another magnetic cylinder 38*; 39 is or may be provided in the transport path through the alignment device 07, preferably in cases in which the third cylinder 39 is embodied as a magnetic cylinder 39, a second drying and/or curing unit 52 is provided as an additional active component 52 on the transport path of the substrate 02, in particular printing substrate 02, to be conveyed through the alignment device 07. Said second drying and/or curing unit is preferably directed, as viewed in the direction of transport T, toward a lateral surface segment of the third cylinder 39, embodied, e.g., as a magnetic cylinder 39, or toward a point on the transport path at which the substrate 02 to be conveyed is guided during operation on said additional magnetic cylinder 38*; 39, although in principle it may also be provided downstream thereof. The point, as viewed in the direction of transport T, toward which the second drying and/or curing unit 52 is directed is preferably once again located at least 90° downstream of the point at which the substrate 02 to be conveyed runs onto this additional magnetic cylinder 38*; 39 along its transport path, and upstream of the point at which the substrate 02 to be conveyed along its transport path via said cylinder 38*; 39 leaves said cylinder 38*; 39 again. It may be advantageous for the circumferential length between the point at which the substrate 02 runs onto the additional magnetic cylinder 38*; 39 and the point at which the second drying and/or curing unit 52 acts to correspond approximately to the corresponding circumferential length on the first magnetic cylinder 37, i.e. up to ±10% of whichever value is greater. The second drying and/or curing unit 52 is preferably embodied as a radiation dryer and preferably operates based on electromagnetic radiation, e.g. with IR or preferably UV radiation. For this purpose, it comprises one or more radiation sources, e.g. IR or preferably UV light sources.

The second drying and/or curing unit 52 can generally be configured in accordance with the first variant of the first drying and/or curing unit 51, for curing or for drying points on print elements 08 that have been applied individually to the substrate 02 but have not yet been dried or cured, for example. Here, the above-described is to be applied accordingly.

In an embodiment that requires relatively little complexity, however, a dryer element and/or curing element 56 extends continuously over the required width, e.g. at least the width of the maximum substrate width to be treated in the device 07, e.g. in the manner of a light bar 56, in particular an LED light bar, which comprises, transversely to the direction of transport, a plurality of radiation sources, e.g. IR or preferably UV radiation sources, in particular a multiplicity thereof, e.g. more than 100, arranged immediately adjacent to one another, i.e. less than 10 mm apart from one another. As with the second variant of the first drying and/or curing unit 52, the radiation sources can preferably be embodied as LED's, e.g. as IR LED's or preferably as UV LED's, and can be arranged, for example, in a one-dimensional or preferably a two-dimensional array. Although this is not mandatory, the dryer element and/or curing element 56 may optionally be embodied as switchable in terms of a sectionwise operation corresponding to the aforementioned second variant of the first dryer element and/or curing element 54.

In an advantageous refinement, the second drying and/or curing unit 52 that comprises the dryer element and/or curing element 56 is embodied as a structural unit or module and as such can be installed in its entirety in or on the side sections 48; 49 of the frame and removed therefrom, in which case the side sections 48; 49 of the frame have, e.g., connection elements or connection points furnished accordingly for that purpose. In an embodiment or configuration in which the third cylinder 39* is configured as a transport cylinder 39*, the second drying and/or curing unit 52 may be omitted or removed during retooling. If the second cylinder 38*, rather than the third cylinder 39*, is embodied or configured as a magnetic cylinder 38*, the second drying and/or curing unit 52 can be installed at appropriately prepared end points on the second cylinder 38*.

If, as is preferred, the alignment device 07 or the machine 01 that comprises said device is configured for handling and treating sheet-format substrate 02, in particular substrate sheets 02, the alignment device 07 comprises, in addition to the at least two and particularly three aforementioned cylinders 37; 38; 39; 37*; 38*; 39*, a transfer point on the input side, at which a substrate sheet 02 to be treated is or can be transferred from the upstream conveyor system 19 to the first cylinder 37; 37* of the alignment device 07, and comprises on the output side a transfer point at which a treated substrate sheet 02 is or can be transferred from the last cylinder 38; 39; 38*; 39* in the cylinder group comprised by the alignment device 07 to a downstream conveyor system 26. In the case of either upstream or downstream transport cylinders, the respective transfer point can generally be formed by the cooperation of a last or first transport cylinder with the first or last cylinder 37; 38; 39; 37*; 38*; 39* of the alignment device 07. In the present case of conveyor systems 19; 26 embodied as revolving gripper conveyors 19; 26, however, the input-side transfer takes place between a gripper bar 22 of the upstream revolving gripper conveyor 19 and the first cylinder 37; 37* and the output-side transfer takes place between the last cylinder 38; 39; 38*; 39* in the cylinder group and a gripper bar 29 of the revolving gripper conveyor 26 that follows said cylinder downstream. The transfer or receiving by the gripper bars 22; 29 preferably takes place in the region where the turn is effected by the respective chain gripper wheel 24; 31, in particular at the level where the transport path intersects with the plane that connects the axle of the chain gripper wheel 24; 31 with the axle of the cylinder 37; 38, 39; 37*; 38*; 39* in question. In an advantageous embodiment, the axle of the chain gripper wheel 24; 31 and the axle of the cylinder 37; 38, 39; 37*; 38*; 39* in question are situated on a vertical plane.

The three-cylinder configuration of the alignment device 07 in the embodiment for handling sheet-format substrate 02 preferably comprises three cylinders 37; 38; 39; 37*; 38; 39* mounted in end-face side sections 48; 49, along with two chain gripper wheels 24; 31; 24'; 31' on at least one of the side sections 48; 49. In an advantageous refinement, the side sections 48; 49 together with crossbars and/or base plates that connect said side sections, the cylinders 37; 38; 39; 37*; 38; 39*, and in an advantageous refinement the chain gripper wheels 24; 31; 24'; 31' are configured as a module in the manner of a structural unit and as such can be installed as a single component in the machine 01 or removed therefrom.

In general, the cylinders 37; 38; 39; 37*; 38; 39* of the cylinder group can be driven by one or more drive motors assigned solely to these cylinders 37; 38; 39; 37*; 38; 39*, e.g. jointly by one or individually by multiple closed-loop position controlled servomotors.

However, in an advantageous embodiment of the alignment device 07 or machine 01 configured for handling and treating sheet-format substrate 02, in particular substrate sheets 02, the cylinders 37; 38; 39; 37*; 38*; 39* of the cylinder group are driven by the revolving gripper conveyor 19; 26 disposed upstream or downstream, in particular via at least one of the two continuous pulling means 21; 28; 21'; 28', in particular continuous chains 21; 28, 21'; 28', of the revolving gripper conveyor 19; 26 in question, in particular the chain gripper system 19; 26. For example, driving is effected via a revolving conveyor 19; 26 on an outer one of the cylinders 37; 38; 39; 37*; 38*; 39*, e.g. the first cylinder 37; 37*, and from there to the remaining cylinders 38; 39; 38*; 39* in succession. For this purpose, for example, at least one and preferably both chain gripper wheels 24; 24', which are situated opposite one another on the sides of the machine, are arranged for conjoint rotation on a shaft 58, on which a gearwheel 57 is also arranged for conjoint rotation. Said gearwheel 57 meshes directly or via an even number of intermediate gearwheels with a gearwheel 59, which is connected for conjoint rotation to the axle of the cylinder 37; 38; 39; 37*; 38*; 39* to be driven, e.g. the first cylinder 37; 37*. Said gearwheel 59 or another gearwheel, which is likewise arranged for conjoint rotation on the axle, meshes with a gearwheel 61, which is connected for conjoint rotation to the axle of the adjacent cylinder 37; 38; 39; 37*; 38*; 39*, e.g. the second cylinder 38; 38* of the cylinder group. Finally, in the case of three cylinders 37; 38; 39; 37*; 38*; 39* the latter gearwheel 61, or an additional gearwheel arranged for conjoint rotation on the same axle meshes with a gearwheel 62, which is connected for conjoint rotation to the axle of the remaining cylinder 37; 38; 39; 37*; 38*; 39*, e.g. the third cylinder 39, 39*. If processing will continue from the alignment device 07 to the other, e.g. downstream conveyor system 26, the latter gearwheel 62 or another gearwheel arranged for conjoint rotation on the same axle meshes directly or via an even number of intermediate gearwheels with a gearwheel 63, which is connected for conjoint rotation to a shaft 64, which bears at least one of the chain gripper wheels 31; 31' for conjoint rotation.

In the described embodiment for handling sheet-format substrate 02, in particular printing substrate 02, the substrate 02 is preferably transferred directly between cylinders 37; 38; 39; 37*; 38*; 39* of the cylinder group that are adjacent to one another in pairs. To prevent flapping and/or grinding, a guide device having blower openings that face the transport path may be provided in the transport path at one or more of the cylinders 37; 38; 39; 37*; 38*; 39*. To avoid friction-induced damage to the coated first side of the substrate 02 during its transfer from the conveyor system 19 to the first cylinder 37; 37*, a guidance unit 73, e.g. an air module having blower air openings that face the transport path, may be provided in the region where the direction of the movement path of the gripper bars 22 changes, said blower air openings supporting the substrate sheet 02 during the change in direction.

In a variation of the aforementioned two-cylinder basic embodiment or configuration, the second cylinder 38* may be embodied as a magnetic cylinder 38* having an above-described pattern of circumferentially arranged magnetic elements 41, 42 or may be configured in this way by retrofitting the basic configuration. In a further variation of the configuration of the two-cylinder group, for example for operation without alignment of a variable image element, both cylinders 37*; 38 may be configured or configurable as transport cylinders 37*; 38.

In the described and preferred case involving a cylinder group with three cylinders 37; 38; 39; 37*; 38*; 39*, in contrast or as an alternative to the aforementioned particularly advantageous embodiment or configuration (see, e.g., FIG. 12*c*)), various other embodiments or configurations may be implemented and may be advantageous:

If only a single-stage orientation of particles contained in the coating medium 06 is provided or required, then in the alignment device 07, as in the basic embodiment, a magnetic cylinder 37 may be provided at only one of the cylinder positions for the cylinders 37; 38; 39; 37*; 38*; 39*, e.g. that of the first cylinder 37, and cylinders 38; 39* configured only as transport cylinders 38; 39* may be provided at the other cylinder positions (see e.g. FIG. 12*b*)).

However, if, for example, a machine 01 containing the alignment device 07 in the transport path is to be operated using a different production process in which, rather than the printing ink 06 that contains the alignable particles, a different printing ink is used, an advantageous configuration may be one, for example, in which a cylinder 37*, 38; 39* configured merely as a transport cylinder 37*; 38; 39* is or will be provided at each of the three cylinder positions (see e.g. FIG. 12*a*)).

In the above-described particularly advantageous embodiment or configuration in which the first and third cylinders 37; 39 are magnetic cylinders 37; 39 and the second cylinder 38 is a transport cylinder 38 (see, e.g., FIG. 12*c*)), a two-stage alignment can be carried out, the alignment taking place from the same side of the transport path in each case.

In an embodiment or configuration that is different therefrom, in which magnetic cylinders 37; 38* are provided at two adjacent cylinder positions, e.g. at those of the first and second cylinders 37; 38*, and a transport cylinder 39* is provided at the other, e.g. third cylinder position, a two-stage alignment is enabled, but from different sides of the transport path (see, e.g., FIG. 12*d*)). In this embodiment or for this configuration option, however, it is advantageous if the aforementioned second drying and/or curing unit 52 or a comparable drying and/or curing unit is or can be provided on the transport path around the second cylinder 38*. Corresponding connection elements or connection points may be provided, for example.

Finally, in a further embodiment or configuration, all three cylinder positions may be equipped with cylinders 37; 38*; 39 configured as magnetic cylinders 37; 38*; 39 (see e.g. FIG. 12*e*)). This makes it possible, for example, following the first alignment of particles of a coated print element 08 and a partial drying or curing in only a portion of the print element 08, to at least partially disperse the order of the particles present in the uncured or undried section on the second magnetic cylinder 38* and/or even to prepare an orientation to be performed on the third magnetic cylinder 39.

If, in an aforementioned embodiment or configuration, the second cylinder 38* is embodied as a magnetic cylinder 38*, it is advantageous for the magnetic elements comprised by said cylinder on the circumference thereof to be arranged with their surfaces that face the transport path offset radially inward from the surfaces that support the substrate 02 on a cylindrical shell surface, i.e. not flush with the supporting surface. This prevents any as yet undried coating medium 06 from being smeared as a result of contact with the magnetic elements.

On the circumference of the cylinder 37; 38*; 39 configured as a magnetic cylinder 37; 38*; 39, a smoothing device, e.g. a plurality of axially spaced reels or one or more rollers, may be provided, which is or can be engaged over the substrate 02 on the cylinder 37; 38*; 39 in the transport path of the substrate 02 between the run-up point thereof and the point of drying or curing.

In an advantageous refinement of the cylinder 37; 38*; 39 configured as a magnetic cylinder 37; 38*; 39, said cylinder can comprise a transmitter, e.g. a coupler, for transmitting electric energy and/or control signals from outside into the rotating cylinder 37; 38*; 39.

In an advantageous embodiment of the alignment device 07, each cylinder 37; 38*; 39 configured as a magnetic cylinder 37; 38*; 39 is equipped with its own vacuum pump for supplying suction air to suction air openings provided on its lateral surface.

Figure 10:
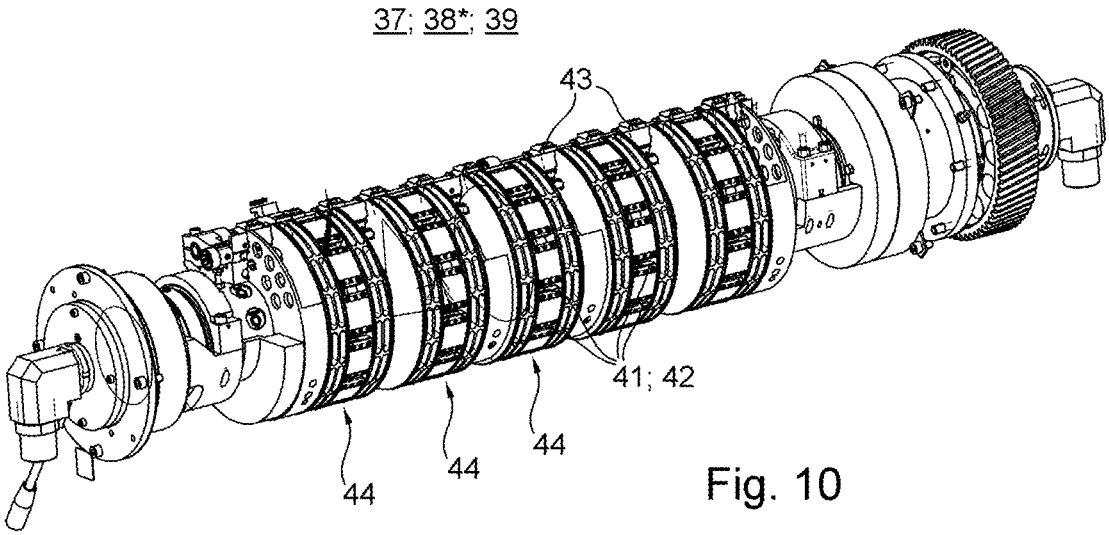
FIG. 10 shows an oblique view of an embodiment of a magnetic cylinder.

The cylinder 37; 38*; 39 configured as a magnetic cylinder 37; 38*; 39 may be configured, e.g. as depicted in FIG. 10, without a covering between the ring elements 44 that bear the magnetic elements 41; 42, and can optionally have additional supporting rings between the ring elements 44, or a covering, e.g. a cover plate, in which regions are hollowed out for the magnetic elements 41; 42 and which has bores, for example, as suction air openings.

Figure 13:
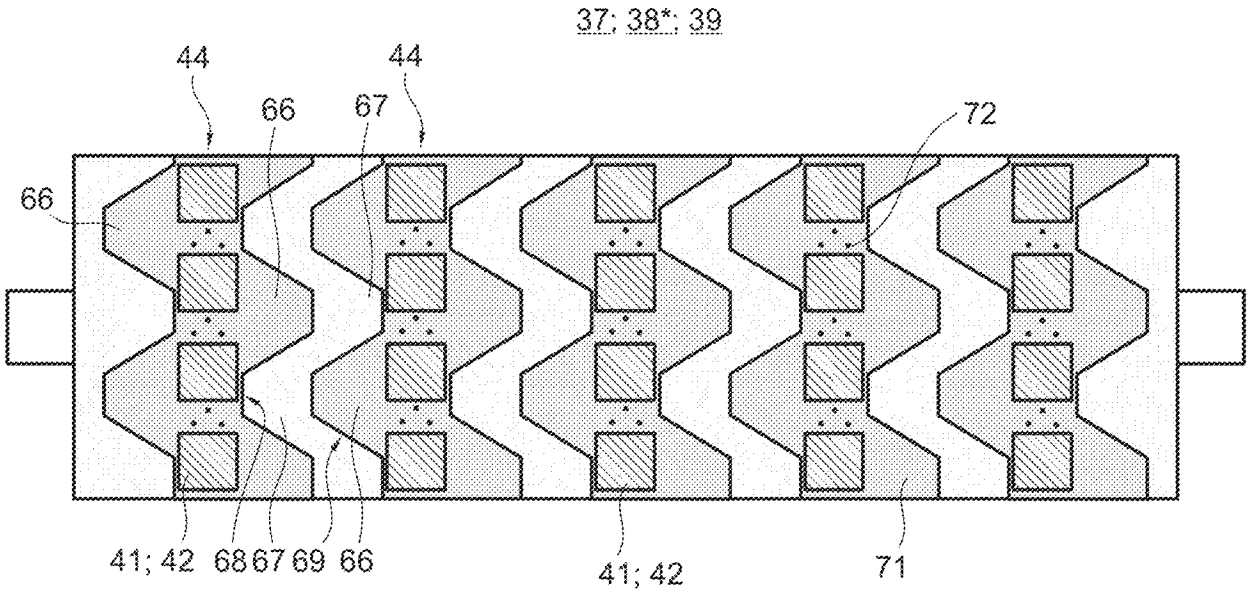
FIG. 13 is a schematic depiction of an advantageous embodiment of a magnetic cylinder.

In an embodiment of the magnetic cylinder 41; 42 that is advantageous in terms of format variability and/or variability in the position of the variable image elements 03 on the substrate 03 or the copies 09 (see, e.g., FIG. 13), at least two adjacent ring elements 44 but preferably all of said axially movable ring elements that contain or can be equipped with the magnetic elements 41; 42 are shaped, at least in a cover element 71 that makes up part of the cylindrical shell surface of the cylinder 39; 38*; 39, on the sides of said element that face one another in the axial direction of the cylinder 37; 38*; 39, in a tooth-like or fan-like manner with protrusions 66, e.g. in the manner of tabs 66 or lugs 66, and with corresponding recesses 67, e.g. cutouts 67 or troughs 67, and are offset in the circumferential direction such that when two adjacent ring elements 44 move axially toward one another, the tooth-like widened sections 66 of one ring element 44 can dip into the corresponding recesses 67 of the other ring element 44. This enables the printing substrate 02 to be supported as uniformly as possible with possible variations in spacing.

Said ring elements 44 may be embodied as single-part or multi-part elements. Said ring elements may be shaped in this tooth-like manner in their entirety, i.e. in the region of their side walls 68; 69 and in the region of the outwardly facing cover elements 71, or in an advantageous embodiment, said ring elements may comprise circular disk-shaped side walls 68; 69 and a cover element 71 that has the recesses 67 and protrusions 66, e.g. covering plates or covering strips 71 that are shaped along their edges in the above-described tooth-like manner.

The cover element 71 may be the outwardly facing wall of a single-piece ring element 44 or a component, e.g. cover plate or cover strip, arranged separately on the ring element 44.

In an advantageous embodiment, the edges of the recesses 67 and protrusions 66 extend in a wavelike manner and are thus formed without sharp corners.

In both cases the cover element 71 has recesses for the magnetic elements 41; 42. A plurality of suction air openings 72 are preferably provided in the respective cover element 71, and negative pressure can be generated in a space lying beneath said cover element between the side walls 68; 69 and the cover element 71 by a line connection to a vacuum pump.

While preferred embodiments of a cylinder, a device, and a machine for aligning magnetic or magnetizable particles on a web-format or a sheet-format substrate, in accordance with the present invention, have been set forth fully completely hereinabove, it will be apparent to one of ordinary skill that various changes could be made thereof, without departing from the true spirit and scope of the present invention, which is accordingly to be limited only by the appended claims.

The invention claimed is:

1. A cylinder for aligning one of magnetic and magnetizable particles contained in a coating medium that is applied to a first side of one of a web-format and a sheet-format substrate, which cylinder has, in a region of its outer circumference, a plurality of magnetic elements;

wherein the plurality of magnetic elements are arranged one of in and on a plurality of ring elements, which plurality of ring elements are spaced apart from one another axially and are adjustably positionable in an axial direction on a shaft of the cylinder;

wherein one of in and on each of the plurality of ring elements a ones of the plurality of magnetic elements are arranged one after another in a circumferential direction of each one of the plurality of ring elements;

wherein at least two adjacent ones of the plurality of ring elements each have a cover element that forms a part of a cylindrical shell surface of the cylinder and that extends in the circumferential direction, at least over a circumferential region of each of the at least two adjacent ones of the plurality of ring elements that are equipped with the plurality of magnetic elements; and wherein cover elements of first and second adjacent ones of the plurality of ring elements, on sides of the cover elements that face one another in the axial direction, each have a plurality of protrusions alternating in the circumferential direction with a plurality of recesses, which recesses and protrusions on the first one of the first and second adjacent ring elements are offset in the circumferential direction of the cylinder from corresponding recesses and protrusions on the second one of the first and second adjacent ring elements whereby, with a relative movement of the first and second ring elements toward one another, the protrusions on the cover element of the first adjacent ring element extend, in a tooth-like manner, into corresponding recesses of the second adjacent ring element and overlap one another, as viewed in the circumferential direction.

2. The cylinder according to claim 1, wherein a number of the protrusions on one of the cover elements that are between the recesses on a second one of the cover elements corresponds to at least half of a number of the plurality of magnetic elements that are provided in the circumferential direction of the at least two adjacent ones of the plurality of ring elements.

3. The cylinder according to claim 1, one of wherein one of four to six of the plurality of ring elements are arranged in the axial direction and two to ten of the plurality of magnetic elements are arranged on each of the plurality of ring elements in the circumferential direction, and wherein the plurality of magnetic elements arranged one of in and on each of the plurality of the ring elements are positionable in the circumferential direction.

4. The cylinder according to claim 1, wherein each of the plurality of ring elements has a cover element having, on the sides thereof that face one another in pairs, the plurality of recesses and protrusions which are offset in the circumferential direction.

5. The cylinder according to claim 1, wherein the axially facing edges of the recesses and protrusions on each of the cover elements on the at least two adjacent ones of the plurality of ring elements extend in a wavelike manner in the circumferential direction.

6. The cylinder according to claim 1, wherein an interruption in a lateral surface of the cylinder is located between the cover elements of the at least two adjacent ones of the plurality of ring elements, as viewed in the axial direction of the cylinder.

7. A device for aligning one of magnetic and magnetizable particles contained in a coating medium that is applied to a first side of one of a web-format and a sheet-format substrate, said device comprising a cylinder arranged in the transport path and wherein the cylinder is embodied as a magnetic cylinder according to claim 1.

8. The device according to claim 7, wherein an additional cylinder is provided, the additional cylinder being arranged in a transport path of the substrate to be conveyed and being embodied as a magnetic cylinder according to claim 1.

9. The device according to claim 8, wherein one of a drying unit and a curing unit is arranged on the transport path between a point at which the substrate runs onto the magnetic cylinder and a point at which the substrate runs onto the additional cylinder.

10. A machine for producing optically variable image elements on a substrate, the machine comprising;

a printing substrate infeed embodied as a sheet feeder;

at least one printing unit having at least one printing couple, by the use of which at least one printing couple the printing substrate that is guided along a transport path through the machine one of is and can be printed at least on a first side;

a product receiving unit, embodied as a pile delivery; and a device for aligning one of the magnetic and the magnetizable particles contained in the coating medium according to claim 7, the device being provided in the transport path of the substrate between the at least one printing unit and the product receiving unit.

* * * * *